US006516761B2

(12) United States Patent
Curtis

(10) Patent No.: US 6,516,761 B2
(45) Date of Patent: Feb. 11, 2003

(54) ADJUSTABLE OVERHEAD ROCKER CAM

(76) Inventor: William P. Curtis, 9403 Judge Ct., Spring Grove, IL (US) 60081

( * ) Notice: Subject to any disclaimer, the term of this patent is extended or adjusted under 35 U.S.C. 154(b) by 0 days.

(21) Appl. No.: 09/925,925

(22) Filed: Aug. 9, 2001

(65) Prior Publication Data

US 2001/0047783 A1 Dec. 6, 2001

Related U.S. Application Data

(63) Continuation-in-part of application No. 09/565,001, filed on May 4, 2000, now Pat. No. 6,273,040.

(51) Int. Cl.[7] ..... F01L 13/00
(52) U.S. Cl. ..... 123/90.16; 123/90.39
(58) Field of Search ..... 123/90.15, 90.16, 123/90.2, 90.39, 90.41

(56) References Cited

U.S. PATENT DOCUMENTS 4,397,270 A * 8/1983 Aoyama ..... 123/90.16
5,189,998 A * 3/1993 Hara ..... 123/90.16
5,682,848 A 11/1997 Hampton et al. ..... 123/90.16
5,809,951 A * 9/1998 Kim ..... 123/90.16
5,979,379 A 11/1999 Sato et al. ..... 123/90.16
5,988,125 A 11/1999 Hara et al. ..... 123/90.16
6,085,705 A * 7/2000 Vorih ..... 123/90.12
6,357,405 B1 * 3/2002 Tsuji et al. ..... 123/90.16

* cited by examiner

*Primary Examiner*—Weilun Lo
(74) *Attorney, Agent, or Firm*—Gildo E. Fato

(57) ABSTRACT

Disclosed is an overhead rocker cam valve operating device for an internal combustion engine and which is particularly useful for race cars or high performance automobiles. The device includes a rocker cam and connecting fixed plate, the rocker cam arm being adjustable within a slot in the fixed plate to provide for more or less power. Hence, the rocker cam arm can be positioned closest to the cam lobe to provide for performance or speed, or can be positioned farther from the cam lobe to provide for less power or economy.

4 Claims, 2 Drawing Sheets

ADJUSTABLE OVERHEAD ROCKER CAM

This application is a continuation-in-part of application Ser. No. 09/565,001 filed May 4, 2000, now U.S. Pat. No. 6,273,040, granted Aug. 14, 2001.

BACKGROUND OF THE INVENTION

1. Field of the Invention

The present invention relates to an adjustable overhead rocker cam valve operating device for an internal combustion engine and, in particular, to a device for use with racecars or high performance automobiles.

2. Description of the Prior Art

Prior valve control systems utilized fixed rocker arms which require considerable movement, or multiple rocker arm elements which are engageable with different cam profiles and means to interconnect the different rocker arm elements. An example is the system described in U.S. Pat. No. 5,623,897, issued Apr. 29, 1997. Other systems utilize a plurality of rocker arms positioned adjacent to one another, and a plurality of valve operating cams. Such a system is described in U.S. Pat. No. 5,979,379, issued Nov. 9, 1999. The overhead rocker cam valve operating device of application Ser. No. 09/565,001, now U.S. Pat. No. 6,273,040, provides a system which can be adjusted for more or less power, namely can be adjusted to a performance mode or an economy mode. However, this system requires a link in engagement with the cam arm, the link being affixed to the engine head or block.

SUMMARY OF THE INVENTION

In accordance with the principle of the present invention, there is provided an overhead rocker cam system which is adjustable and minimizes valve train movement. The system provides geometric advantages such that the rocker arm does not move away from the valve stem in an excessive manner. The rocker cam is adjustable so that the farther away the connecting pin is moved from the rocker cam, the less extra lift is provided. Thus, the rocker cam and connecting pin can be adjusted for more or less power or, with a performance type automobile, can be adjusted to a performance mode or an economy mode.

In particular, this invention provides fixed side plates, the rocker cam positioned there between, whereby the link of the prior invention, in engagement with the cam arm and affixed to the engine head, is no longer required. The side plates include a slot for receiving the pin in the cam arm to provide for suitable adjustment of the cam system. In addition to eliminating the need for a link in engagement with the cam arm and affixed to the engine head, the system provides a "square" profile of the lift versus duration curve, providing more power.

DETAILED DESCRIPTION OF THE PREFERRED EMBODIMENTS

The present invention is described with reference to the embodiments illustrated in the accompanying drawings. It should be understood, however, that no limitation of the scope of the invention is intended. Such alterations and modifications of the illustrated devices which utilize the principles of the invention as illustrated and described herein, and which would occur to one skilled in the art to which the invention pertains, are included.

Figure 1:
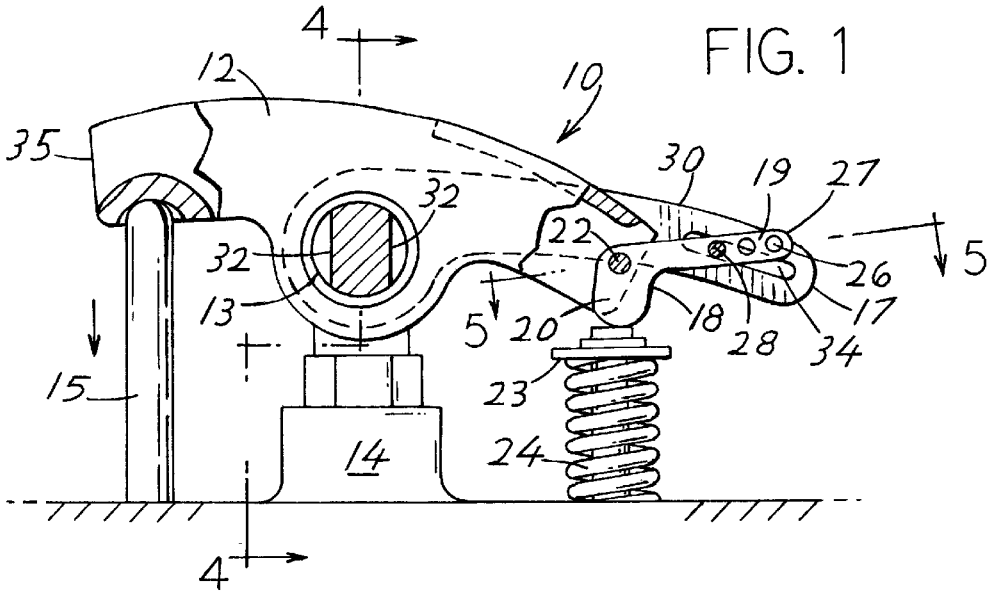
FIG. 1 is a side elevational view of one embodiment of the overhead rocker cam system of the present invention when the rocker arm is at the full lift position.
Figure 2:
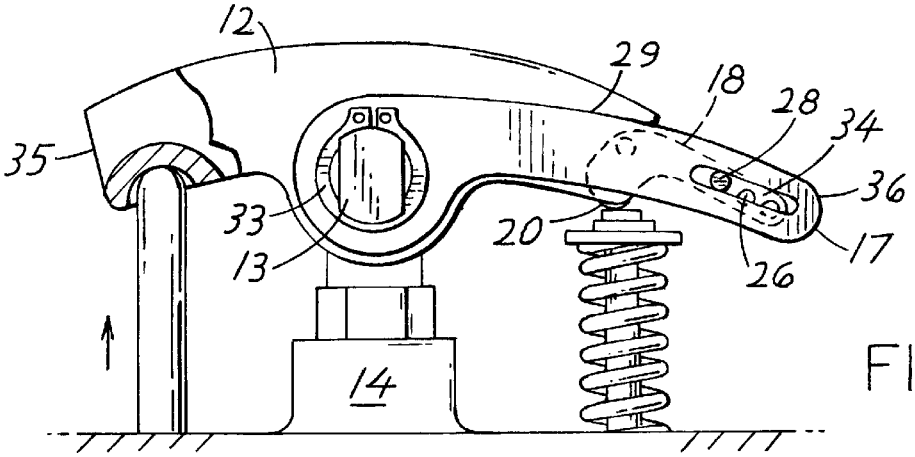
FIG. 2 is a side elevational view of the overhead rocker cam system of the present invention when the rocker arm is at the at-rest position.
Figure 3:
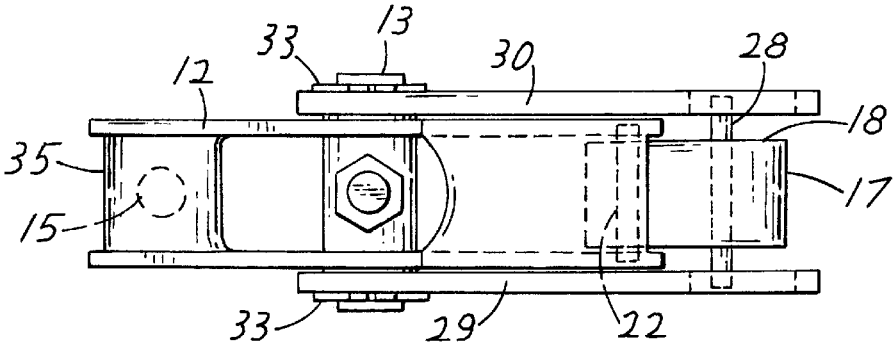
FIG. 3 is an overhead view of the rocker cam system of the present invention as seen in FIG. 1 or 2.
Figure 4:
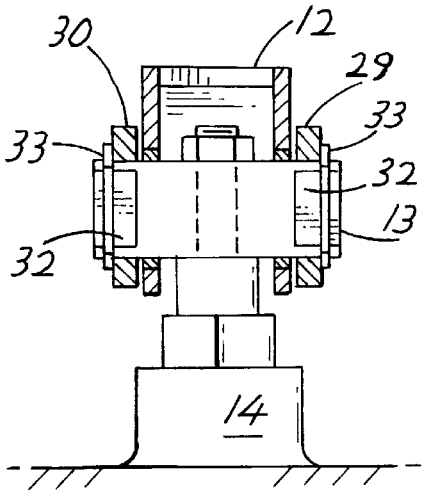
FIG. 4 is an end elevational view of one embodiment of the rocker cam of FIG. 1 or 2 taken along the line 4—4 of FIG. 1.
Figure 5:
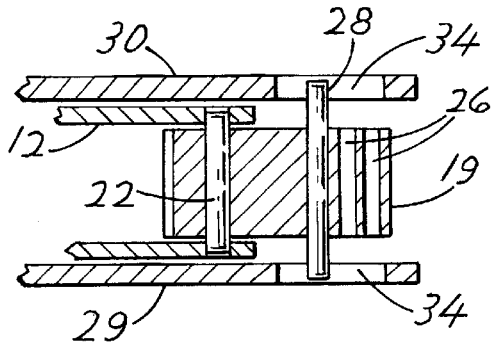
FIG. 5 is a partial overhead view of the embodiment of FIG. 1 or 2 taken along the line 5—5 of FIG. 1.
Figure 6:
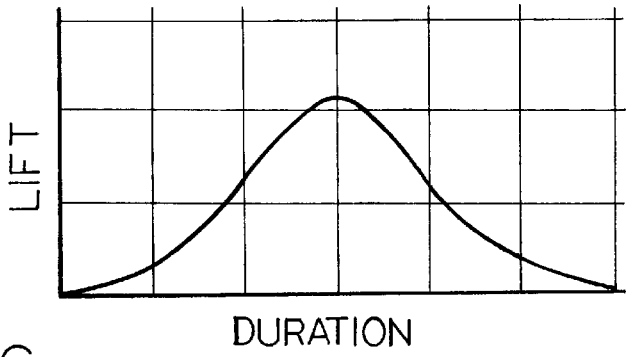
FIG. 6 (PRIOR ART)
FIG. 6 is a chart illustrating the valve lift versus duration of a prior art system.
Figure 7:
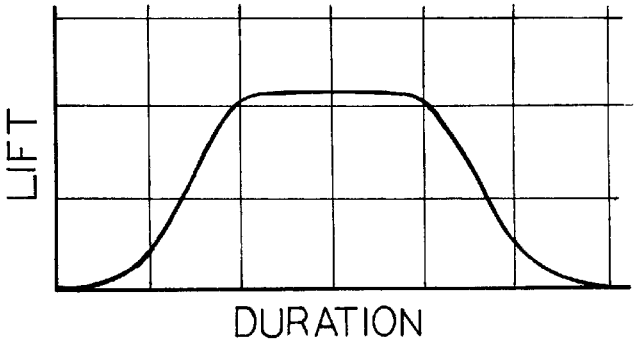
FIG. 7 is a chart illustrating the valve lift versus duration of a system of the present invention.

A first embodiment of the present invention is described with reference to FIGS. 1 to 6. FIG. 1 illustrates an overhead rocker cam device 10 of the present invention at the full lift or actuated position. The device 10 comprises a pivoted rocker arm 12, pivoted on a rod 13. The rocker arm 12 is mounted on a base 14 and is actuated by a push rod 15 connected to a camshaft (not shown). Alternatively, a separate cam (not shown) can be positioned above the rocker arm 12 to actuate the rocker arm 12. At proximal end 17 of the rocker arm 12 is positioned a rocker cam 18 comprising a cam arm 19 and a cam lobe 20. The rocker cam 18 is pivoted on a pin 22 and actuates a valve 23 and spring 24. The cam arm 19 includes adjustable means selectably adjustable to a position closest to the cam lobe 20 to provide greater engine power and to a position farther from the cam lobe 20 to provide greater fuel economy. In the embodiment illustrated, the cam arm 19 of the rocker cam 18 includes two or more openings 26 so that the rocker cam 18 can be operatively connected to the rocker arm 12 by means of a pin 22. The end 27 of the cam arm 19 includes a removable pin 28 so that the end 27 of the cam arm 19 can be positioned in any of the openings 26.

This embodiment is particularly suited for a racing automobile for example, to which adjustments can be made to the engine without the necessity of changing cams. By moving the pin 28 closer to the cam lobe 20, more actuation is obtained with quicker opening and closing rate of the valve 23 and which results in more valve lift and duration with consequently more power. By moving the pin 28 farther away from the cam lobe 20, less actuation is obtained with consequently less power. Such adjustments can be made quickly, as noted, without having to change cams and is advantageous if adjustments are necessary during a race.

The embodiment includes at least one fixed plate 29 or 30 which is positioned on the rod 13 in the base 14 over a flat 32 in the end of the rod 13 so that the plate 29, for example, is not moveable. The plate 29 is held in place on the rod 13 by means of a lock ring 33. Each of the plates 29 and 30 includes a slot 34 in the end 36 opposite the distal end 35 for receiving the removable pin 28 whereby the cam arm 19 is engageable with the plates 29 and 30. As noted, the removable pin 28 can be positioned in one of the openings 26, depending on the actuation desired, namely, to obtain more or less power, as previously described.

In an overhead valve system in which no push rod is utilized, a cam can be positioned directly above the valve.

In an alternative system (not shown), for example, a fixed sprocket can replace the fixed plate 29, the fixed, toothed sprocket being in engagement with a toothed pulley in engagement with the rocker cam, the sprocket and pulley being in connection by means of a timing belt. When the rocker arm is actuated, the toothed pulley will turn while the toothed sprocket will remain fixed. Likewise, a gear system can be utilized in which a large fixed gear is in engagement with a smaller gear which in turn is in engagement with an eccentric on the rocker arm to activate the cam.

Hence, the overhead rocker cam device 10 of the present invention has a number of advantages in addition to being adjustable. For example, it minimizes valve train movement. Previous systems, with fixed rocker arms, required more movement; namely, the valve stem travels linearly while the rocker arm travels in a circular manner. With the system of the present invention, the rocker arm 12 moves away from the valve 23 while the rocker cam 18 moves toward the valve. This results in changes in geometry from the rocker arm to the valve stem since valve lift and duration is achieved not only from the primary cam shaft but also from the rocker cam 18. Another benefit of the described device and system is that the same valve lift as previous systems is obtained but with a smaller camshaft.

Although the preferred embodiments of the present invention have been illustrated and described in the foregoing description, it is understood that changes and modifications within the scope of the invention, as defined in the following claims, are included.

What is claimed is:

1. An adjustable rocker cam device for an internal combustion engine including a push rod, cam shaft and engine valve, said device comprising:

a fixed plate mounted on a base, the plate including a fixed position on a distal end thereof whereby said plate is unmoveable;

a rocker arm pivotally mounted on the base, one end of said rocker arm adapted for engagement with the push rod, and having a distal end;

a rocker cam pivotably mounted on the distal end of the rocker arm and including a lobe for engagement with the valve and a cam arm extending from the lobe, the cam arm including one or more openings therein; and a pin adjustable between said openings in the cam arm, the plate including a slot in the end opposite the distal end for receiving the pin in the cam arm.

2. The adjustable rocker cam device of claim 1 wherein the cam arm includes at least two separate openings for receiving the pin, the pin being selectably adjustable to the opening closest to the rocker cam lobe to provide greater engine power and being selectably adjustable to the opening further from the rocker cam lobe to provide greater fuel economy.

3. The adjustable rocker cam device of claim 1 including a second fixed plate with a distal end fixedly mounted on the base opposite said first plate and including a slot in the end opposite the distal end, the slot being opposite the slot in the first plate and for receiving the pin in the cam arm.

4. An adjustable rocker cam device for an internal combustion engine including a push rod, cam shaft and engine valve, said device comprising:

two fixed plates mounted on a base in a spaced apart position opposite each other and having a distal and proximal end, the distal ends thereof being affixed to the base whereby said plates are unmoveable;

a rocker arm pivotally mounted on the base between said plates, one end of said rocker arm adapted for engagement with the push rod, and having a distal end;

a rocker cam pivotably mounted on the distal end of the rocker arm and including a lobe for engagement with a valve and an arm extending from the lobe, the arm including at least two spaced apart openings therein, the rocker cam positioned between the two fixed plates; and a pin adjustable between said openings, said pin being removably receivable in one of the openings in the rocker cam arm, whereby the pin is selectably adjustable to the opening closest to the rocker cam lobe to provide greater engine power and is selectably adjustable to the opening further from the rocker cam lobe to provide greater fuel economy.

* * * * *